US007367905B2

(12) United States Patent
Sato et al.

(10) Patent No.: US 7,367,905 B2
(45) Date of Patent: May 6, 2008

(54) GOLF BALL

(75) Inventors: Katsunori Sato, Chichibu (JP); Atsuki Kasashima, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 9 days.

(21) Appl. No.: 11/332,245

(22) Filed: Jan. 17, 2006

(65) Prior Publication Data

US 2007/0167258 A1 Jul. 19, 2007

(51) Int. Cl.
*A63B 37/12* (2006.01)

(52) U.S. Cl. ..... 473/383

(58) Field of Classification Search ..... 473/378–385
See application file for complete search history.

(56) References Cited

U.S. PATENT DOCUMENTS 4,869,512 A * 9/1989 Nomura et al. ..... 473/383
7,018,308 B2 3/2006 Kasashima
2003/0158002 A1* 8/2003 Morgan et al. ..... 473/383
2004/0198536 A1* 10/2004 Ohama et al. ..... 473/378
2004/0204267 A1* 10/2004 Sajima et al. ..... 473/378

FOREIGN PATENT DOCUMENTS

JP 2001-321460 A 11/2001
JP 2003-290390 A 10/2003

* cited by examiner

*Primary Examiner*—Raeann Trimiew
(74) *Attorney, Agent, or Firm*—Sughrue Mion, PLLC

(57) ABSTRACT

A golf ball has a spherical surface bearing a plurality of plan view circular dimples and plan view non-circular dimples, which non-circular dimples have at a top edge position a contour length of at least 20 mm and account for at most 10% of all the dimples. The ball has a surface with a novel and unique aesthetic appearance, and exhibits an excellent flight performance.

13 Claims, 3 Drawing Sheets

GOLF BALL

BACKGROUND OF THE INVENTION

The present invention relates to a golf ball having numerous dimples on the surface thereof. More specifically, it relates to a golf ball endowed with both an excellent flight performance and a unique appearance.

Owing primarily to machining technology constraints, the dimples arranged on the spherical surface of a golf ball are for the most part circular in shape as seen in a plan view. Recently, to achieve greater novelty of design, the use of dimples with shapes other than a circular shape, such as oval, elliptical, or dewdrop shapes, has become more common. However, most of these non-circular dimples have relatively simple contours that are arcuate in certain portions thereof. Other non-circular dimples which are known to the art include polygonal dimples, such as those having triangular or hexagonal shapes. Owing to the difficulty of precisely forming, using existing machining technology, non-circular dimples having a complex shape with a long contour, efforts to improve both the flight performance and also the aesthetic appearance of the ball have hitherto been unsuccessful. Moreover, given the low freedom of design allowed by such technology, merely improving the aesthetic appearance of the golf ball has been a challenge.

SUMMARY OF THE INVENTION

It is therefore an object of the present invention to provide a golf ball in which, through the skillful combination and arrangement of non-circular dimples having a novel shape with circular dimples, the improvement in flight performance and the improvement in aesthetic appearance desired of golf balls can both be achieved.

As a result of extensive investigations, we have found that, in a golf ball having a spherical surface with a plurality of dimples thereon, by providing a combination of dimples that are circular as seen in a plan view with dimples that are non-circular as seen in a plan view and specifically by giving the non-circular dimples a contour length at a top edge position thereon of at least 20 mm and having the non-circular dimples account for at most 10% of all the dimples, the surface of the ball can be endowed with an aesthetic appearance that is unexpectedly novel and unique, and the ball itself can be imparted with an excellent flight performance.

Accordingly, the invention provides the following golf ball.

[1] A golf ball comprising a spherical surface having a plurality of plan view circular dimples and plan view non-circular dimples, wherein the non-circular dimples have at a top edge position a contour length of at least 20 mm and account for at most 10% of all the dimples.

[2] The golf ball of [1], wherein the contour at the top edge position of the non-circular dimples is formed by a combination of a plurality of curvilinear shapes.

[3] The golf ball of [1], wherein the contour at the top edge position of the non-circular dimples is formed by a combination of curved lines and straight lines.

[4] The golf ball of [1], wherein the total number of circular dimples and non-circular dimples is from 250 to 550.

[5] The golf ball of [1], wherein the non-circular dimples have a bottom portion which is formed in the shape of an arc that projects radially outward on the ball.

[6] The golf ball of [1], wherein the non-circular dimples have a recessed volume, summed for all the non-circular dimples on the ball, which is at most 0.5% of the volume of the ball were the spherical surface to be free of dimples.

BRIEF DESCRIPTION OF THE DIAGRAMS

DETAILED DESCRIPTION OF THE INVENTION

The invention is described more fully below.

Figure 1:
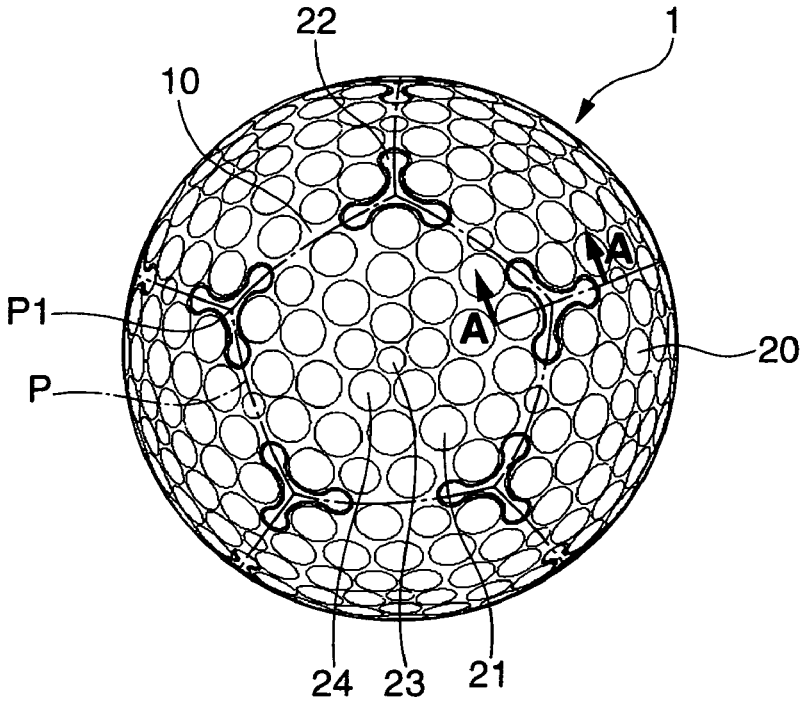
FIG. 1 is a plan view showing the dimple arrangement on a golf ball according to a first embodiment of the invention.
Figure 2:
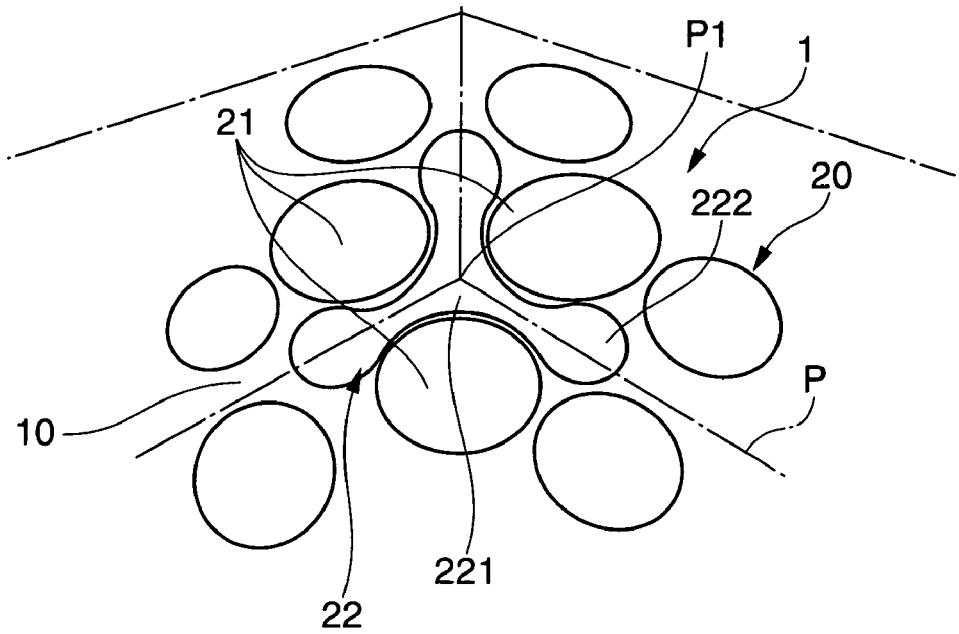
FIG. 2 is a partially enlarged view of dimples in FIG. 1.
Figure 3:
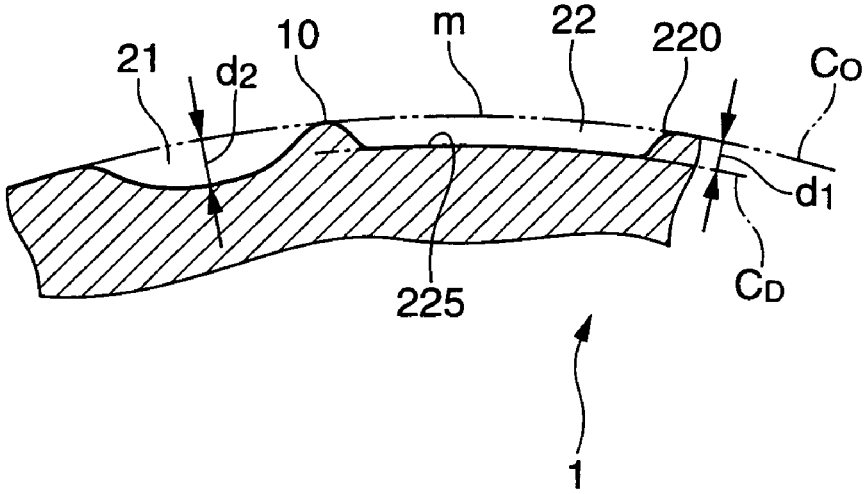
FIG. 3 is a cross-sectional view taken along A-A in FIG. 1.
Figure 4:
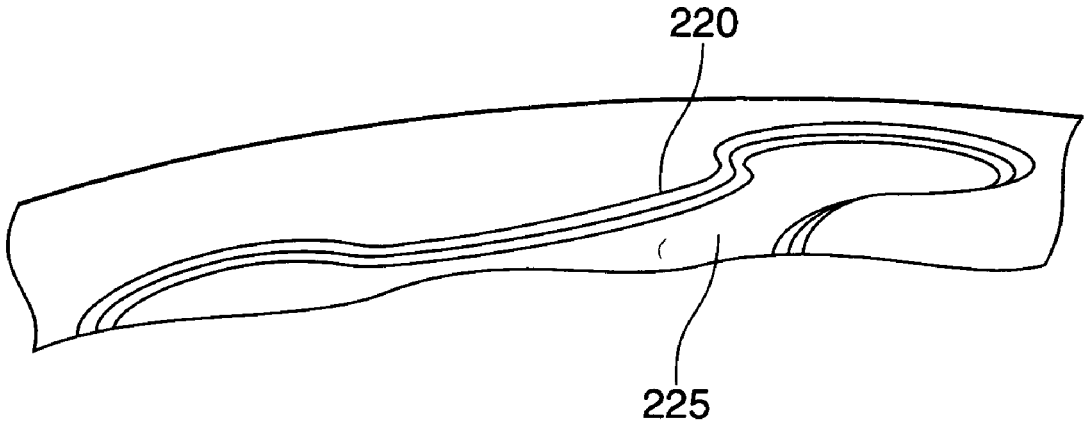
FIG. 4 is a partially enlarged perspective view of a non-circular dimple in FIG. 1.

FIG. 1 is a plan view of a golf ball according to a first embodiment of the invention, FIG. 2 is a partially enlarged view of dimples used on the same ball, and FIG. 3 is a cross-sectional view taken along A-A in FIG. 1. FIG. 4 is a partially enlarged perspective view of a non-circular dimple according to the present invention.

The present invention provides a golf ball 1 having a spherical surface with plan view (i.e., as seen from directly above the ball) circular dimples 21 and plan view non-circular dimples 22 thereon. The inventive golf ball is characterized in that the non-circular dimples 22 have, at a top edge position 220 thereon, a contour length of at least 20 mm and account for at most 10% of the total number of dimples. The shapes of the circular dimples 21 and non-circular dimples 22 described below are the "plan view shapes" as seen from directly above the ball.

The contour at the top edge position 220 of the non-circular dimples 22 may be formed by a combination of a plurality of curvilinear shapes, or by a combination of curved lines and straight lines.

In the first embodiment of the invention shown in FIG. 1, the dimples 20 are arranged in the manner of a spherical dodecahedron. In the diagram, one of the unit pentagons P making up the spherical dodecahedron is indicated by dash-dot lines. A small-diameter circular dimple 23 is disposed at the center position of the unit pentagon P, and three relatively large-diameter circular dimples 24 are rectilinearly disposed toward each of the vertices of the unit pentagon P from this position. In addition, three circular dimples are arranged in each of five remaining spaces within the unit pentagon P, with two of the three dimples being disposed along the edge of the unit pentagon P and one of the three dimples being disposed to the inside thereof so that the three dimples together exhibit a substantially triangular shape. In addition, one small-diameter circular dimple is disposed on three of the five sides of the unit triangle.

Each vertex P1 position on the above unit pentagon P is a common vertex shared by two additional vertices P1 of other unit pentagons P in which circular dimples 21 are disposed in the same manner as described above.

Next, referring to FIG. 2, a non-circular dimple 22 is disposed within the spaces between the circular dimples 21 that are each disposed next to a vertex of the unit pentagon P. The non-circular dimple 22 extends in three different directions at angles therebetween of 120° from the position of the vertex P1 of the unit pentagon P. Describing the shape of the non-circular dimples 22 in the present embodiment, because each such dimple extends in three directions along the spaces between the dimples 20 positioned next to the vertices P1 of the unit pentagon P, the non-circular dimples 22 are formed by curved lines more or less similar to the contour shapes of the circular dimples 21. However, the non-linear dimples 22 are formed by the combination of a plurality of shapes rather than by a simple curved line. Each non-circular dimple 22 has a central region 221 which is relatively broad, from which position the dimple 22 narrows in three different directions, then widens out into end regions 222 where the dimple 22 terminates. This non-circular dimple 22 has a contour length at a top edge position 220 which is generally at least 20 mm, and preferably at least 25 mm. The contour length is not subject to any particular upper limit, although a value of not more than 40 mm is desirable. The maximum contour length at the top edge position 220 of the circular dimple 21 is generally about 16 mm. Hence, the non-circular dimple 22 has a contour length which is considerably longer than that of an ordinary dimple. In the embodiment shown in FIGS. 1 and 2, the non-circular dimple 22 is divided into three substantially equal portions by three intersecting sides of unit pentagons P, as a result of which one-third of the dimple lies in each of the respective unit pentagons P.

Referring to FIG. 3, which is a cross-sectional view taken along A-A in FIG. 1, an arc $C_O$ indicated by the dash-dot-dot line is an imaginary arc m that circumferentially connects the apices of land regions 10 located furthest from the center (not shown) of a golf ball 1, and has a center which coincides with the center of the golf ball. The bottom portion 225 of a non-circular dimple 22 extends substantially parallel with the imaginary curved line $C_O$ in this embodiment, and therefore exhibits a shape which projects radially outward on the ball. In FIG. 3, this extension $C_D$ is indicated by a dash-dot line. Accordingly, the center of the arc $C_D$ which represents the bottom shape of the non-circular dimple 22 coincides with the center of the above arc $C_O$. The shape of the dimple bottom 225 is clearly depicted in the partial perspective view show in FIG. 4. By contrast, the circular dimples have a bottom shape with a curvature which, as shown in FIG. 3, is the opposite of that of the non-circular dimples.

No particular limitation is imposed on the depth $d_1$ of the non-circular dimple 22 from the imaginary curve $C_O$ at the spherical surface, although it is preferable for the non-circular dimples 22 to be formed so as to have a depth $d_1$ which is equal to or somewhat shallower than the depth $d_2$ of the neighboring circular dimples 21 from the imaginary curve $C_O$ at the spherical surface. More specifically, the depth may be set within a range of 0.05 to 0.5 mm. Aside from the desirability of an arrangement which has a good overall balance, the arrangement of non-circular dimples 22 on the spherical surface of the golf ball is subject to no particular limitation. Examples of suitable arrangements include those in the form of a spherical polyhedron, such as a spherical icosahedron, a spherical dodecahedron or a spherical octahedron. For example, as described above and illustrated by the first embodiment shown in FIG. 1, by adopting a spherical dodecahedral configuration and disposing substantially the same non-circular dimple 22 at each vertex P1 of the unit pentagons P, the dimples 20 will be arranged in a good balance over the entire spherical surface.

Figure 5:
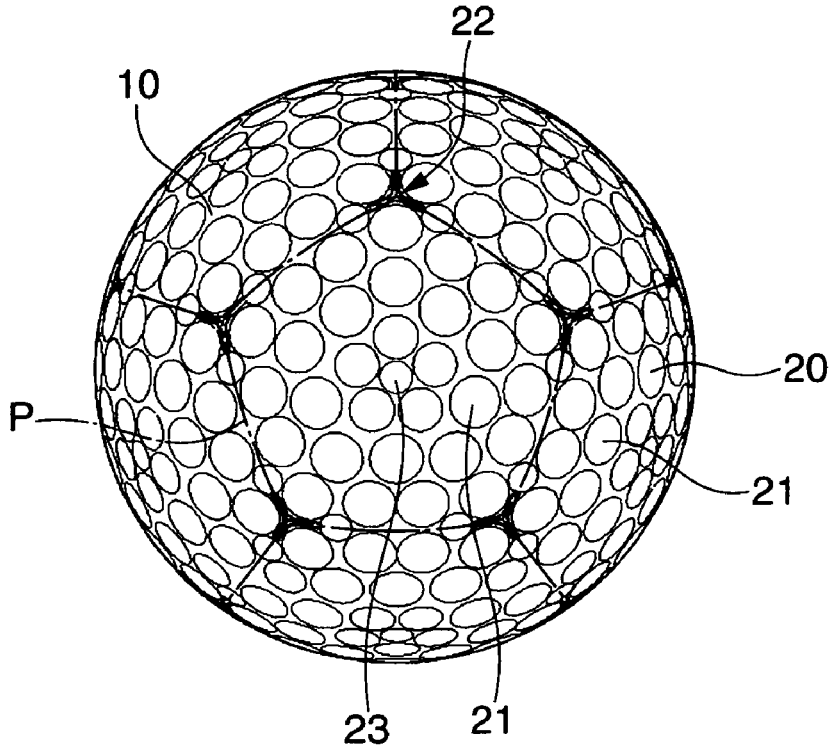
FIG. 5 is a plan view showing a dimple arrangement on a golf ball according to a second embodiment of the invention.

FIG. 5 is a top view of a golf ball according to a second embodiment of the invention. This embodiment is characterized by the formation of non-circular dimples 22 which exhibit a trifurcated pattern delineated by the extension of mutually parallel straight lines in three different directions at angles of 120° from a center region and by the use of curved lines to connect the mutually parallel straight lines at their respective ends. In other respects, the makeup of the dimples on the surface of the ball are substantially the same as in the first embodiment.

Referring to FIG. 3, in the non-circular dimples 22, the volume of the recess in the portion of the dimple below the imaginary line $C_O$ at the spherical surface, summed for all the non-circular dimples 22 on the ball, is preferably not more than 0.5%, and more preferably from 0.01 to 0.45%, of the golf ball volume were the spherical surface to be free of dimples.

The total number of circular dimples and non-circular dimples on the surface of the inventive golf ball, while not subject to any particular limitation, is preferably from 250 to 550, and more preferably from 300 to 450. It is critical that the non-circular dimples account for at most 10% of the total number of dimples.

The inventive golf ball may be constructed as a one-piece ball in which the entire ball is made of a single resilient material such as synthetic rubber, as a two-piece ball or a multi-piece ball of three or more pieces composed of a resilient core made of rubber or the like which is enclosed on the outside by a cover made of one or more type of resin, or as a thread-wound ball. No particular limitation is imposed on the materials in the core and cover making up the internal construction of the golf ball. Various known thermoplastic resins and thermoplastic elastomers, such as synthetic rubbers (e.g., polybutadiene, polyisoprene), ionomer resins, polyester elastomers and polyurethane resins, may be suitably selected for use as the primary materials therein and adjusted to the desired thickness and hardness according to the intended purpose of each ball. The weight and diameter of the overall golf ball may be set as appropriate in accordance with the Rules of Golf. Generally, the ball is formed to a diameter of not less than 42.67 mm and a weight of not more than 45.93 g.

In an exemplary method of forming the above-described circular and non-circular dimples, numerous projections corresponding to the shapes of the respective dimples are provided on the walls of the cavity in a golf ball mold, and dimples are formed on the surface of the golf ball cover by using the mold to carry out injection molding. To fabricate such a mold, a technique may be employed in which, as is commonplace in the art, 3D CAD/CAM is used to directly cut the entire surface shape three-dimensionally into a master mold from which the golf ball mold is subsequently made by pattern reversal, or to directly cut three-dimensionally the walls of the cavity for the golf ball mold.

As explained above, the golf ball of the invention has a surface with an aesthetic appearance that is novel and unique, and also has an excellent flight performance.

EXAMPLES

The following Examples of the invention and Comparative Examples are provided by way of illustration and not by way of limitation.

Examples 1 to 3, Comparative Example 1

Comparative tests of flight performance were conducted between the balls obtained in Examples 1 to 3 and the balls obtained in Comparative Example 1 described below.

Although the construction of the balls furnished to these tests is not shown here, the balls all shared the construction described below.

That is, the golf balls in each example were 42.7 mm diameter balls having a solid, three-piece construction composed of a spherical solid core of 37.7 mm diameter made of polybutadiene rubber, a 1.5 mm thick inner cover layer made of ionomer resin enclosing the core, and a 1.0 mm thick outer cover layer made of polyurethane resin enclosing the inner core layer.

Dimple arrangements for some of the balls in these examples are shown in the attached diagrams. Specifically, FIG. 1 shows the dimple arrangement in Example 1, FIG. 5 shows the dimple arrangement in Example 2, and FIG. 6 shows the dimple arrangement in Comparative Example 1.

Details concerning the dimples in the respective examples are given in Table 1 below.

TABLE 1

Figure 6:
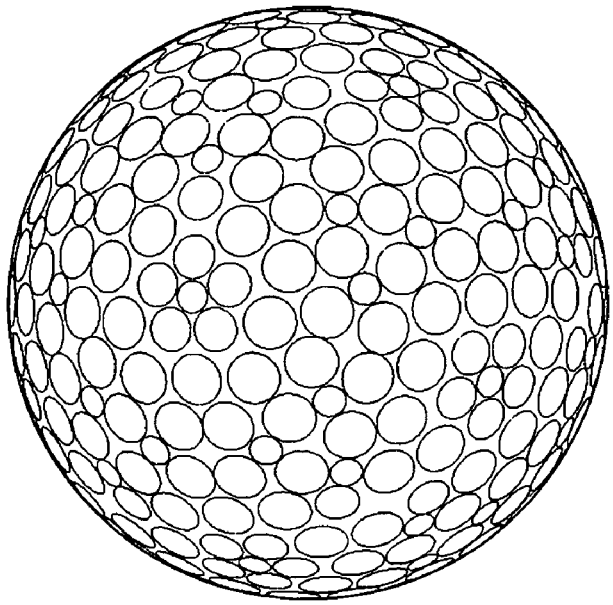
FIG. 6 is a plan view showing a dimple arrangement on a golf ball according to the prior art (comparative example).

| | Example 1 | Example 2 | Comparative Example 1 |
|---|---|---|---|
| Corresponding diagram | FIG. 1 | FIG. 5 | FIG. 6 |
| Total number of dimples | 420 | 392 | 432 |
| Number of non-circular dimples | 18 | 22 | 0 |
| Proportion of non-circular dimples (%) | 4.29 | 5.61 | 0.00 |
| Contour length of non-circular dimples (mm) | 31.00 | 33.32 | — |
| Volume of a single non-circular dimple ($mm^3$) | 2.27 | 1.12 | — |
| Total volume of all non-circular dimples ($mm^3$) | 40.82 | 24.55 | — |
| Volume ratio (%) | 0.098 | 0.059 | — |

Note:
The sum of the recessed volumes of all the non-circular dimples on a golf ball was divided by the golf ball volume were it to be free of dimples on the spherical surface. The quotient was multiplied by 100 and expressed in percent (%).

The golf balls obtained in each of the above examples were hit at a head speed of 45 m/s with a W#1 club mounted on a swing robot, and both the carry and the total distance were measured. Those results are shown in Table 2 below. The W#1 club was a Tour Stage X500 (loft angle, 10°) manufactured by Bridgestone Sports Co., Ltd.

TABLE 2

| | | Example 1 | Example 2 | Comparative Example 1 |
|---|---|---|---|---|
| Distance | Carry (m) | 222 | 218.8 | 217.5 |
| | Total (m) | 232.5 | 228.5 | 225.6 |

The invention claimed is:

1. A golf ball comprising a spherical surface having a plurality of plan view circular dimples and plan view non-circular dimples, wherein the non-circular dimples have at a top edge position a contour length of at least 20 mm and account for at most 10% of all the dimples, wherein the non-circular dimples have a bottom portion which is formed in the shape of an arc that projects radially outward on the ball.

2. The golf ball of claim 1, wherein the contour at the top edge position of the non-circular dimples includes concave curved portions and convex curved portions as viewed from an inside of the non-circul dimples.

3. The golf ball of claim 1, wherein the contour at the top edge position of the non-circular dimples is formed by a combination of curved lines and straight lines.

4. The golf ball of claim 1, wherein the total number of circular dimples and non-circular dimples is from 250 to 550.

5. The golf ball of claim 1, wherein the non-circular dimples are formed so as to have a depth which is shallower than the depth of the neighboring circular dimples.

6. The golf ball of claim 1, wherein the circular dimples are disposed in a plurality of unit polygons disposed on an outer spherical surface of the golf ball such that a predetermined pattern of the circular dimples is repeated in each unit polygon, the plurality of unit polygons arranged to cover the outer spherical surface of the golf ball, wherein the non-circular dimples are arranged at each vertex of adjoining ones of the plurality of unit polygons.

7. The golf ball of claim 1, wherein at least one of the non-circular dimples has a central region from which the at least one non-circular dimple narrows in three different directions and then widens out into end regions where the at least one non-circular dimple terminates.

8. A golf ball comprising a spherical surface having a plurality of plan view circular dimples and plan view non-circular dimples, wherein the non-circular dimples have at a top edge position a contour length of at least 20 mm and account for at most 10% of all the dimples, wherein the non-circular dimples have a recessed volume, summed for all the non-circular dimples on the ball, which is at most 0.5% of the volume of the ball were ball were the spherical surface to be free of dimples.

9. The golf ball of claim 8, wherein the contour at the top edge position of the non-circular dimples includes concave curved portions and convex curved portions as viewed from an inside of the non-circular dimples.

10. The golf ball of claim 8, wherein the contour at the top edge position of the non-circular dimples is formed by a combination of curved lines and straight lines.

11. The golf ball of claim 8, wherein the total number of circular dimples and non-circular dimples is from 250 to 550.

12. The golf ball of claim 8, wherein the non-circular dimples are formed so as to have a depth which is shallower than the depth of the neighboring circular dimples.

13. The golf ball of claim 8, wherein the circular dimples are disposed in a plurality of unit polygons disposed on an outer spherical surface of the golf ball such that a predetermined pattern of the circular dimples is repeated in each unit polygon, the plurality of unit polygons arranged to cover the outer spherical surface of the golf ball, wherein the non-circular dimples are arranged at each vertex of adjoining ones of the plurality of unit polygons.

* * * * *